US011953006B2

(12) United States Patent
Zhu et al.

(10) Patent No.: US 11,953,006 B2
(45) Date of Patent: Apr. 9, 2024

(54) SCREW COMPRESSOR AND CONTROL METHOD THEREFOR

(71) Applicants: York (Wuxi) Air Conditioning and Refrigeration Co., Ltd., Wuxi (CN); Johnson Controls Tyco IP Holdings LLP, Milwaukee, WI (US)

(72) Inventors: Yu Zhu, Wuxi (CN); Zhengxiang Yu, Wuxi (CN); Fanfei Zeng, Wuxi (CN); Fengzhi Zhang, Wuxi (CN)

(73) Assignees: Tyco Fire & Security GMBH, Schaffhausen (CH); York (Wuxi) Air Conditioning and Refrigeration Co., Ltd., Jiangsu (CN)

( * ) Notice: Subject to any disclaimer, the term of this patent is extended or adjusted under 35 U.S.C. 154(b) by 128 days.

(21) Appl. No.: 17/421,699

(22) PCT Filed: Aug. 20, 2019

(86) PCT No.: PCT/CN2019/101576

§ 371 (c)(1),
(2) Date: Jul. 8, 2021

(87) PCT Pub. No.: WO2020/143229

PCT Pub. Date: Jul. 16, 2020

(65) Prior Publication Data

US 2022/0090601 A1 Mar. 24, 2022

(30) Foreign Application Priority Data

Jan. 9, 2019 (CN) ..... 201910018609.4

(51) Int. Cl.

| | |
|---|---|
| ***F04C 18/16*** | (2006.01) |
| ***F04C 28/08*** | (2006.01) |
| ***F04C 28/12*** | (2006.01) |

(52) U.S. Cl.
CPC ..... *F04C 18/16* (2013.01); *F04C 28/08* (2013.01); *F04C 28/12* (2013.01)

(58) Field of Classification Search
CPC ..... F01C 21/106; F04C 18/16; F04C 18/084; F04C 28/08; F04C 28/12; F04C 28/20;
(Continued)

(56) References Cited

U.S. PATENT DOCUMENTS

| | | | |
|---|---|---|---|
| 4,281,975 | A | 8/1981 | Blackwell |
| 4,457,681 | A | 7/1984 | Garland |

(Continued)

FOREIGN PATENT DOCUMENTS

| | | | |
|---|---|---|---|
| CN | 201943955 | U | 8/2011 |
| CN | 202100461 | U | 1/2012 |

(Continued)

OTHER PUBLICATIONS

PCT International Search Report for PCT Application No. PCT/CN2019/101576 dated Nov. 25, 2019, 4 pgs.
European Search Report for EP Application No. 19908893.1, dated Aug. 19, 2022, 8 pages.

*Primary Examiner* — Shafiq Mian
*Assistant Examiner* — Dapinder Singh
(74) *Attorney, Agent, or Firm* — Fletcher Yoder, P.C.

(57) ABSTRACT

A screw compressor (100), comprising a screw rotor (110) and a spool valve (120). The screw rotor (110) comprises a suction head end (111) and an exhaust tail end (112). Gas is sucked in from the suction head end (111) and compressed gas is discharged from the exhaust tail end (112). The spool valve (120) comprises a working side (125) for sealing a compression chamber of the screw rotor (110). The working side (125) comprises a spool valve head end (121) and a spool valve tail end (122) and can do a reciprocating motion along the axis direction of the screw rotor (110). When the spool valve (120) moves to a suction capacity adjusting
(Continued)

position (240), the spool valve head end (121) is located at the inner side of the suction head end (111) of the screw rotor (110), and a suction capacity adjusting distance (D2) is formed between the spool valve head end (121) and the suction head end (111) so that the suction capacity of the screw compressor is adjusted. The suction capacity of the screw compressor (100) can be adjusted by means of the spool valve (120), so that the problem of motor temperature and exhaust gas temperature limits of conventional variable frequency screw sets is effectively solved and the operational range and the load regulation ability of the screw compressor are expanded.

12 Claims, 9 Drawing Sheets

(58) Field of Classification Search
CPC ..... F04C 28/24; F04C 28/06; F04C 29/12; F04C 29/124; F04C 29/021; F04C 2240/81; F04C 2240/20; F04C 2270/09; F04C 2270/605; F04C 2270/80; F04C 2270/86
See application file for complete search history.

(56) References Cited

U.S. PATENT DOCUMENTS

| | | | | |
|---|---|---|---|---|
| 5,832,737 | A * | 11/1998 | Moilanen | F04C 28/125 417/310 |
| 11,306,721 | B2 * | 4/2022 | Scala | F25B 31/026 |
| 11,460,026 | B2 * | 10/2022 | Mikulic | F04C 18/16 |
| 2008/0038127 | A1 | 2/2008 | Yonemoto et al. | |
| 2017/0211574 | A1 * | 7/2017 | Loerch | F04C 28/28 |
| 2018/0356128 | A1 | 12/2018 | Johnson et al. | |

FOREIGN PATENT DOCUMENTS

| | | | |
|---|---|---|---|
| CN | 103486037 | A | 1/2014 |
| CN | 204099200 | U | 1/2015 |
| CN | 108035877 | A | 5/2018 |
| EP | 1553300 | A1 | 7/2005 |
| JP | S60165803 | U | 11/1985 |
| JP | H05231363 | A | 9/1993 |
| JP | 2000199491 | A | 7/2000 |
| WO | 2016055412 | A1 | 4/2016 |
| WO | 2017094057 | A1 | 6/2017 |
| WO | 2018024201 | A1 | 2/2018 |

* cited by examiner

SCREW COMPRESSOR AND CONTROL METHOD THEREFOR

CROSS-REFERENCE TO RELATED APPLICATIONS

This application is a U.S. National Stage Application of PCT Application No. PCT/CN2019/101576, entitled "SCREW COMPRESSOR AND CONTROL METHOD THEREFOR," filed Aug. 20, 2019, which claims priority to and the benefit of Chinese Patent Application No. 201910018609.4, filed Jan. 9, 2019, each of which is herein incorporated by reference in its entirety for all purposes.

TECHNICAL FIELD

The present application relates to screw compressors, and in particular to a device and a method for adjusting or controlling screw compressors by means of a spool valve.

BACKGROUND ART

The screw compressor is a common component in refrigeration units. In a screw compressor, a pair of screw rotors are engaged with each other by means of the tooth space, resulting in a change in the volume of the elements composed of the tooth space to complete gas suction, compression and discharge. A pair of engaged screw rotors are arranged in parallel in the body of a screw compressor. One end of the screw rotor is the suction end, which is connected to the suction port of the machine body; while the other end is the exhaust end, which is connected to the exhaust port of the machine body. As the screw rotors rotate, gas is sucked in from the suction end, compressed, and discharged from the exhaust end.

The working frequency F and the internal volume ratio Vi are two important working parameters of screw compressors. The suction capacity can be adjusted by changing the working frequency F of the screw compressor. The higher the working frequency F, the faster the screw rotors rotate, and the higher the suction capacity. When the effective chamber volumes of the suction end and the discharge end are set reasonably, the internal volume ratio Vi (Vi=Vs/Nd) of the screw compressor can be adjusted, where Vs is the suction chamber volume and Vd is the discharge chamber volume.

The internal volume ratio Vi of a screw compressor can be adjusted by adjusting a spool valve. Specifically, a spool valve is arranged along the axis of the screw rotor, and can wrap or cover a portion of the screw rotor along the axis direction. By moving the spool valve along the axial direction, the volume of the suction chamber and/or the volume of the discharge chamber can be changed, thereby adjusting the internal volume ratio Vi.

The integrated part load value (IPLV) is an indicator used to assess the real-time operation efficiency of a unit. When the working frequency parameter F and the internal volume ratio parameter Vi are adjusted according to different loads, it is possible for a screw compressor to operate at the best efficiency point, thereby improving the operation performance of the entire unit. For example, for a unit used in building refrigeration systems, the load varies in a large range due to seasonal changes in indoor and outdoor temperature difference or to meet different cooling requirements on different floors, and so it is necessary to adjust the screw compressor in a larger range accordingly.

SUMMARY OF THE INVENTION

The purpose of the present invention is to improve the integrated part load value of screw compressors under different loads by adjusting the spool valve of the screw compressor.

To this end, the present application provides a screw compressor, which combines frequency variation and a spool valve to adjust the suction capacity, so that the spool valve can be used to adjust the suction capacity when it can no longer be adjusted by lowering the frequency due to the limited operational range of the screw compressor, thus effectively solving the problem of motor temperature and exhaust temperature limits of conventional variable frequency sets and expending the operational range and load regulation ability of screw compressors.

The present application provides a screw compressor, comprising: a screw rotor, which comprises a suction head end and an exhaust tail end, wherein the screw rotor is configured such that it can suck in gas from the suction head end and discharge compressed gas from the exhaust tail end; and a spool valve, which comprises a working side for sealing a compression chamber of the screw rotor, wherein the working side comprises a spool valve head end and a spool valve tail end, the spool valve head end and the spool valve tail end are arranged in the same direction as the suction head end and the exhaust tail end of the screw rotor along the axis direction of the screw rotor, and the spool valve is configured such that it can do a reciprocating motion along the axis direction of the screw rotor; specifically, the spool valve is configured such that it can move to a suction capacity adjusting position; when it is in the suction capacity adjusting position, the spool valve head end is located at the inner side of the suction head end of the screw rotor, and a suction capacity adjusting distance is formed between the spool valve head end and the suction head end; the suction capacity adjusting distance is such that the spool valve can adjust the suction capacity of the screw compressor without changing the speed of the screw rotor.

In the above screw compressor, the spool valve is configured such that it can move to an internal volume ratio adjusting position; when it is in the internal volume ratio adjusting position, the spool valve head end is located at the outer side of the suction head end of the screw rotor or is aligned with the suction head end, so that the spool valve can adjust the internal volume ratio of the screw compressor.

The screw compressor according to the above further comprises: a position sensor, which is located between the suction head end and the exhaust tail end of the screw rotor in the axis direction and is in contact with the spool valve, and which is configured such that it can indicate the position of the spool valve.

In the screw compressor according to the above, the non-working side of the spool valve has an inclined surface that is inclined relative to the screw rotor in the axis direction; and the position sensor comprises a probe whose position in the axis direction is fixed, wherein one end of the probe is in contact with the inclined surface and can slide relative to the inclined surface as the spool valve moves, so that the probe can move in a direction perpendicular to the axis as the spool valve moves; specifically, the position sensor can determine the position of the spool valve based on the distance that the probe moves in the direction perpendicular to the axis.

In the screw compressor according to the above, the non-working side of the spool valve has a groove extending along the axis direction, and the bottom surface of the groove is inclined relative to the screw rotor in the axis direction; and the probe has a contact end and a measurement end, wherein the contact end extends into the groove and contacts the bottom surface of the groove, and can slide relative to the bottom surface as the spool valve moves; and the measurement end protrudes from the groove; specifically, the position sensor can determine the position of the spool valve based on the length of the portion of the probe protruding from the groove.

In the screw compressor according to the above, when the spool valve is in a first position, the spool valve head end is located at the outer side of the suction head end of the screw rotor, part of the spool valve is used to shield a section of the screw rotor extending from the suction head end to the exhaust tail end, and the screw compressor has the actual minimum internal volume ratio $Vi_{min}$, wherein the first position is the position of the maximum stroke that the spool valve moves toward the suction head end; when the spool valve is in a second position, the spool valve head end is aligned with the suction head end of the screw compressor, all the spool valve is used to shield a section of the screw rotor extending from the suction head end to the exhaust tail end, and the screw compressor has the actual maximum internal volume ratio $Vi_{max1}$; and when the spool valve is in a third position, the spool valve head end is located at the inner side of the suction head end of the screw compressor, all the spool valve is used to shield the section of the screw rotor between the suction head end and the exhaust tail end, and the screw compressor has a virtual maximum internal volume ratio $Vi_{max2}$, wherein the third position is the position of the maximum stroke that the spool valve moves toward the exhaust tail end.

In the screw compressor according to the above, the screw compressor is configured such that it can adjust the position of the spool valve between the first position and the second position to adjust the internal volume ratio Vi of the screw compressor; and the screw compressor is configured such that it can adjust the position of the spool valve between the second position and the third position to adjust the suction chamber volume of the screw compressor, thereby adjusting the suction capacity of the screw compressor.

The screw compressor according to the above further comprises: a piston rod, which is connected to the spool valve tail end and is configured such that it can be hydraulically driven to drive the spool valve to move reciprocally along the axis direction.

The screw compressor according to the above further comprises: a controller, which is configured such that it can adjust the speed of the screw rotor and can, through a piston rod actuator, drive the piston rod to adjust the position of the spool valve.

In another aspect, the present application also provides a control method for the screw compressor, comprising: a) setting the working frequency parameter F and the working internal volume ratio parameter Vi of the screw compressor based on the target load, wherein the working frequency parameter F corresponds to a predetermined working suction capacity R; and b) determining whether the working frequency parameter F is lower than the working frequency threshold Ft, wherein the working frequency threshold Ft corresponds to the threshold suction capacity Rt; and c) adjusting the position of the spool valve based on the set working frequency parameter F and the working internal volume ratio parameter Vi, wherein: c1) when the working frequency parameter F is no lower than the working frequency threshold Ft, the working frequency of the screw compressor is taken as the working frequency parameter F, to adjust the speed of the screw rotor of the screw compressor, so that the suction capacity of the screw compressor is adjusted to the predetermined working suction capacity R, the displacement L1 for the spool valve to move to the internal volume ratio adjusting position corresponding to the working internal volume ratio parameter Vi is determined based on the set working internal volume ratio parameter Vi, the spool valve is moved to the internal volume ratio adjusting position based on the displacement L1, and, when it is in the internal volume ratio adjusting position, the spool valve head end of the spool valve is located at the outer side of the suction head end of the screw rotor of the screw compressor or aligned with the suction head end, so that the spool valve can shield a section of the screw rotor extending from the suction head end to the exhaust tail end; and c2) when the working frequency parameter F is lower than the working frequency threshold Ft, the working frequency of the screw compressor is taken as the working frequency threshold Ft, to adjust the speed of the screw rotor, the displacement L2 for the spool valve to move to the suction capacity adjusting position corresponding to the predetermined working suction capacity R is determined based on the set working internal volume ratio parameter Vi (a virtual Vi area), the spool valve is moved to the suction capacity adjusting position based on the displacement L2, and, when it is in the suction capacity adjusting position, the spool valve head end is located at the inner side of the suction head end of the screw rotor, and a suction capacity adjusting distance is formed between the spool valve head end and the suction head end, so that the threshold suction capacity Rt corresponding to the working frequency threshold Ft can be adjusted to the predetermined working suction capacity R.

In the control method for the screw compressor according to the above, the actual internal volume ratio reached in step c1 is equal to the set working internal volume ratio parameter Vi, and the working internal volume ratio parameter Vi of the compressor falls between the actual minimum internal volume ratio $Vi_{min}$, and the actual maximum internal volume ratio $Vi_{max1}$; and the actual internal volume ratio reached in step c2 is determined by the predetermined working suction capacity R, and the working internal volume ratio parameter Vi of the compressor falls between the actual maximum internal volume ratio $Vi_{max1}$ and the virtual maximum internal volume ratio $Vi_{max2}$.

In the control method for the screw compressor according to the above, the working frequency threshold Ft corresponds to the minimum speed for the normal operation of the screw compressor.

The concept, specific structure and the technical effect of the present application will be described further below with reference to the drawings for a full understanding of the purpose, features and effect of the present application.

BRIEF DESCRIPTION OF THE DRAWINGS

The present application will become easier to understand when the following detailed description is read in conjunction with the drawings. Throughout the drawings, the same reference signs represent the same parts, wherein.

DETAILED DESCRIPTION OF EMBODIMENTS

Figure 1A:
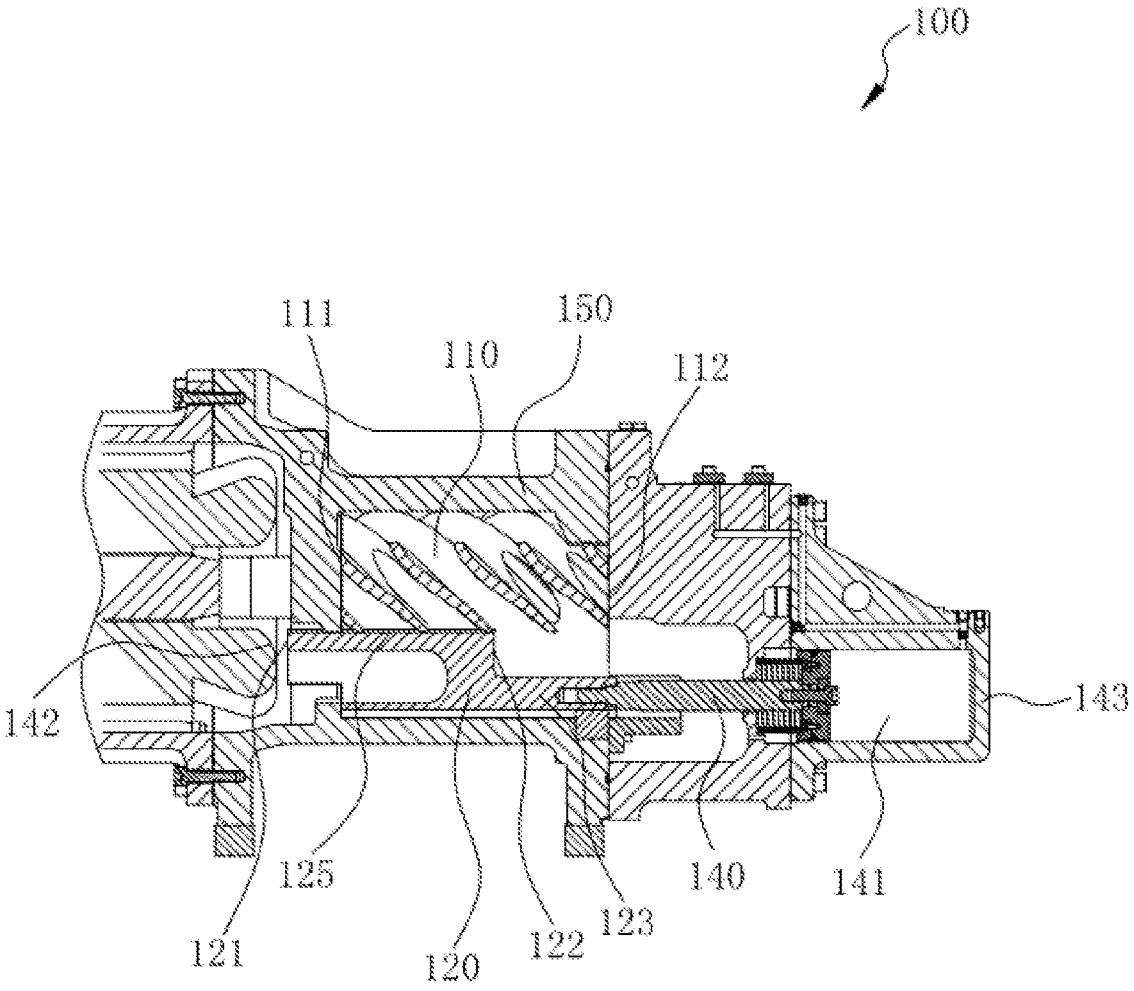
FIG. 1A is a sectional view of the screw compressor along the axis direction of the screw rotor in one embodiment according to the present application.

The present application relates to a Chinese patent application filed on 23 Sep. 2014, with the application number 201420548889.2, titled "Screw Compressor with Adjustable Volume Ratio", and a PCT patent application filed on 1 Aug. 2017, with the application number PCT/CN2017/095491, titled "A Screw Compressor with Male and Female Rotors". The full text of the above patent applications is incorporated into the present application by citation.

Various specific embodiments of the present application will be described below with reference to the drawings which form a part of this description. It should be understood that although directional terms such as "front", "back", "upper", "lower", "left", "right", "inner", "outer", "top", "bottom", "forward", "reverse", "near end", "far end", "transverse", and "longitudinal" are used in the present application to describe the structural parts and components of various examples of the present application, these terms are used here only to simplify the description, and they are determined based on the exemplary orientations shown in the drawings. Since the embodiments disclosed in the present application can be implemented in different directions, these directional terms are only for illustration purposes but may not be deemed as limiting.

The sequential numerals such as "first" and "second" referenced in the present application are only for differentiating and identifying, without any other meaning. They do not mean a specific sequence or a specific correlation if not specified as such. For example, the term "a first component" itself does not imply the existence of "a second component", and the term "a second component" itself does not imply the existence of "a first component".

Figure 1B:
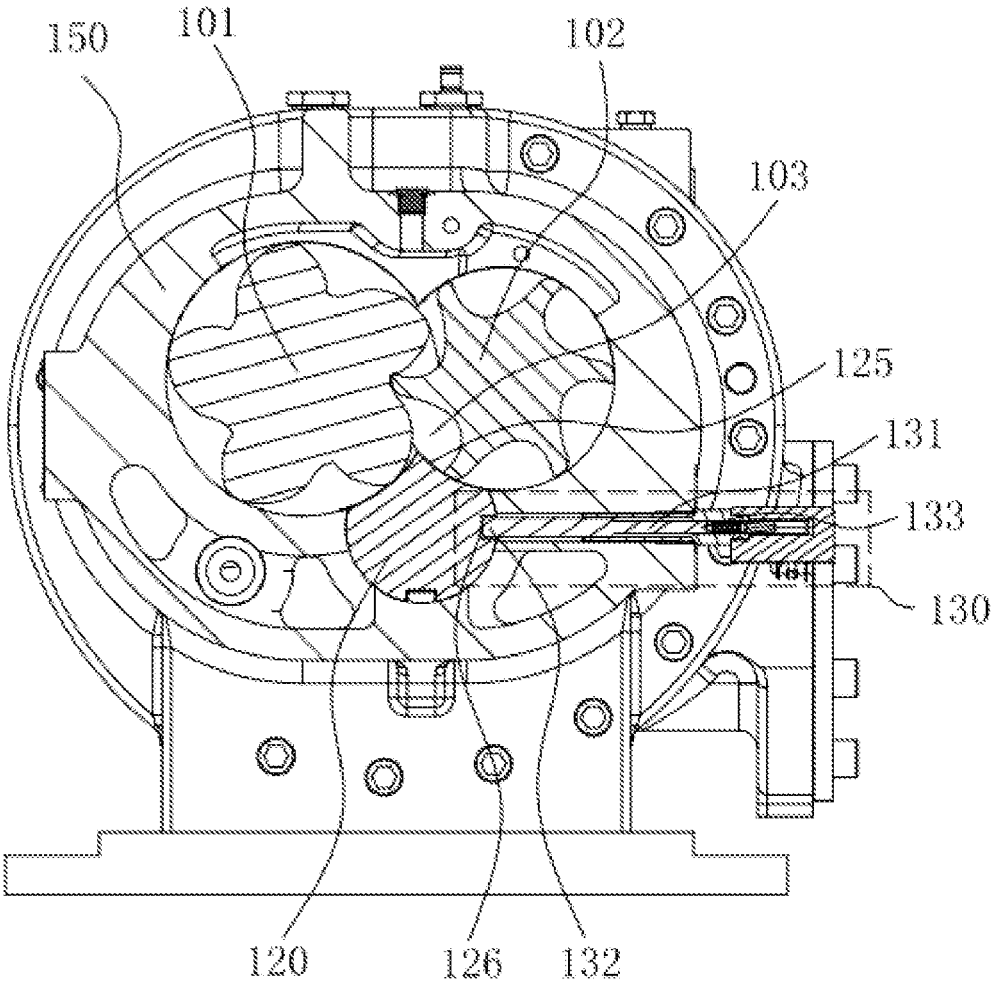
FIG. 1B is a sectional view of the screw compressor shown in FIG. 1A along the radial direction of the screw rotor.

FIG. 1A is a sectional view of the screw compressor 100 along the axis direction of the screw rotor 110 in one embodiment according to the present application, and FIG. 1B is a sectional view of the screw compressor 100 shown in FIG. 1A along the radial direction of the screw rotor 110. As shown in FIGS. 1A and 1B, the screw compressor 100 comprises a rotor housing 150 and a screw rotor 110 and a spool valve 120 that are provided in the rotor housing 150. The screw rotor 110 comprises a pair of male rotor 101 and female rotor 102 that engage with each other, wherein the male rotor 101 and the female rotor 102 rotate under the drive of a rotor actuator (not shown). The male rotor 101 has five helical convex teeth, and the female rotor 102 has six helical grooves. The male rotor 101 and the female rotor 102 form an engaged structure through the convex teeth and the grooves, and form a compression chamber 103 with the rotor housing 150 and the spool valve 120.

The screw rotor 110 has a suction head end 111 and an exhaust tail end 112 along the axis direction of the screw rotor 110. Gas is sucked into the compression chamber 103 from the suction head end 111, and moves gradually toward the exhaust tail end 112 as the screw rotor 110 rotates. At the same time, as the screw rotor 110 rotates, the volume of the compression chamber 103 gradually decreases, and the gas in the compression chamber 103 is gradually compressed. The compressed gas is discharged from the exhaust tail end 112.

The spool valve 120 is located below the screw rotor 110 and can reciprocate along the axis direction of the screw rotor 110. Along the length of the spool valve 120 in the axis direction of the screw rotor 110, the spool valve 120 comprises a working side 125 for sealing the compression chamber 103 together with the rotor housing 150, and a non-working side that is not used for sealing the compression chamber 103. The working side 125 of the spool valve 120 has a spool valve head end 121 and a spool valve tail end 122. In the axis direction of the screw rotor 110, the spool valve head end 121 and the spool valve tail end 122 are arranged in the same direction as the suction head end 111 and the exhaust tail end 112 of the screw rotor 110, i.e., the spool valve head end 121 is located close to the suction head end 111, and the spool valve tail end 122 is located close to the exhaust tail end 112. The side of the spool valve 120 on the spool valve tail end 122 also extends outward to from a connecting end 123.

Through the working side 125, the spool valve 120 can seal or wrap a part of the compression chamber 103 formed by the screw rotor 110. By moving the spool valve 120 to different positions along the axis direction of the screw rotor 110 (refer to FIGS. 2A-2E), the working side 125 can shield or seal different parts of the screw rotor 110, thereby changing the suction chamber volume Vs and/or the discharge chamber volume Vd accordingly to adjust the internal volume ratio Vi of the screw compressor 100.

The screw compressor 100 further comprises a driving device for driving the spool valve 120 to move. According to one embodiment of the present application, the driving device may be a hydraulic driving device, which comprises a piston rod 140 and a hydraulic chamber 141. One end of the piston rod 140 is arranged in the hydraulic chamber 141, and the other end of the piston rod 140 is connected to the connecting end 123 of the spool valve 120, so that the piston rod 140 can reciprocate in the axial direction as the liquid pressure in the hydraulic chamber 141 changes and can drive the spool valve 120 to move reciprocally.

The screw compressor 100 further comprises a limiting structure for limiting the maximum stroke of the spool valve 120 in the axial direction. As shown in FIG. 1A, a stop block 142 is provided on one side of the suction head end 111 of the screw rotor 110 to limit the maximum stroke of the spool valve head end 121 to the left. The side wall 143 of the hydraulic chamber 141 can limit the maximum stroke of the piston rod 140 to the right, thereby limiting the maximum stroke of the spool valve 120 to the right. Driven by the piston rod 140, the spool valve 120 can reciprocate between the maximum stroke positions on the left and right.

As shown in FIG. 1B, the screw compressor 100 further comprises a position sensor 130 for indicating the position of the spool valve 120. In the axis direction of the screw rotor 110, the position sensor 130 is located between the suction head end 111 and the exhaust tail end 112 of the screw rotor 110. The position sensor 130 is in contact with the spool valve 120 and can change as the spool valve 120 moves to different positions, thereby indicating the position of the spool valve 120.

Figure 3:
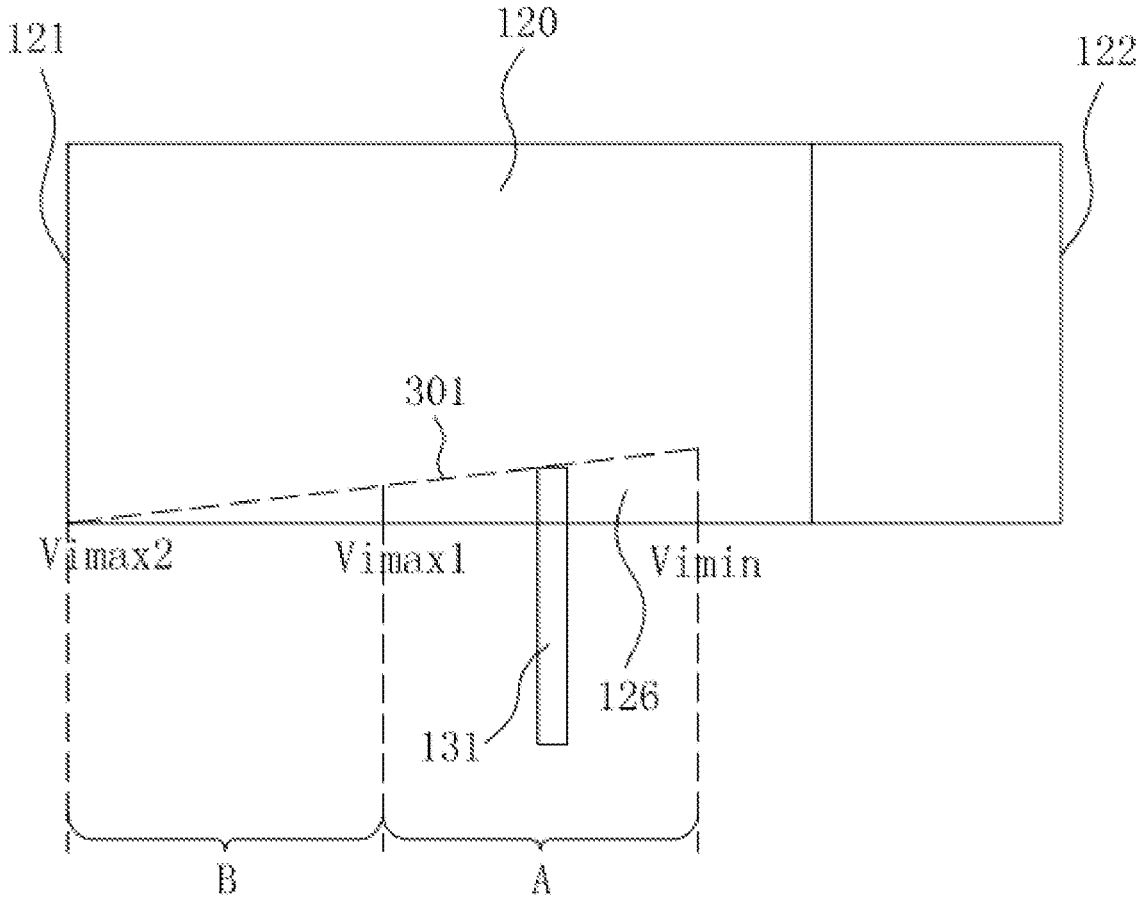
FIG. 3 is a simplified schematic diagram of the spool valve and the probe shown in FIG. 1B.

In the embodiment shown in FIGS. 1A and 1B, the spool valve 120 has a groove 126 extending in the axial direction on the non-working side, and the bottom surface 301 of the groove 126 is an inclined surface inclined relative to the screw rotor 110 in the axial direction (refer to FIG. 3). The position sensor 130 comprises a probe 131, which is fixed in position relative to the axis direction of the screw compressor and can reciprocate in a direction perpendicular to the axial direction (for example, in the radial direction). For example, the probe 131 is installed on the rotor housing 150, and a bias spring is provided between them. The probe 131 has a contact end 132 and a measurement end 133. The contact end 132 extends into the groove 126 and can maintain contact with the bottom surface 301 of the groove 126 during the movement of the spool valve in the axial direction. The measurement end 133 protrudes from the groove 126. When the spool valve 120 moves in the axial direction, the contact end 132 of the probe 131 can slide relative to the bottom surface 301 of the groove 126 along with the movement of the spool valve 120, so that the probe 131 moves in the radial direction. In this way, the position of the spool valve 120 can be determined based on the change in the length of the portion of the probe 131 protruding from the groove 126.

In some embodiments, a magnetic core is provided on the measurement end 133 of the probe 131, and a coil connected to a circuit is provided around the magnetic core. As the probe 131 moves, the length or position of the magnetic core extending into the coil changes, so that the inductance of the coil changes accordingly, and a corresponding voltage or current signal is generated in the circuit. In this way, these electric signals can be used to indicate or determine the position of the spool valve 120.

FIGS. 2A-2E are a series of simplified schematic diagrams of the relative positions of the spool valve 120 and the screw rotor 110 of the screw compressor 100 shown in FIG. 1A, which are used to show changes in the relative positions of the spool valve 120 and the screw rotor 110 during the movement process.

Figure 2A:
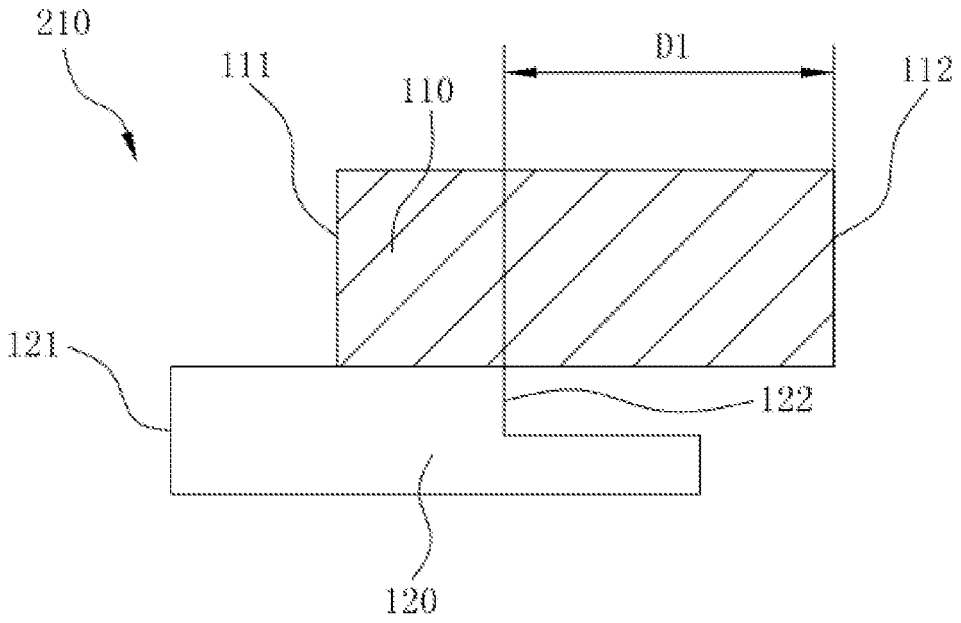
FIGS. 2A-2E are a series of simplified schematic diagrams of the relative positions of the spool valve and the screw rotor of the screw compressor shown in FIG. 1A.

As shown in FIG. 2A, the spool valve 120 is located at the position of the maximum stroke moving toward the suction head end 111 (to the left), and this position is a first position 210 of the spool valve 120. At the first position 210, the spool valve head end 121 is located at the outer side of the suction head end 111 of the screw rotor 110. A part of the working side 125 of the spool valve 120 is located below the screw rotor 110, so as to shield or seal a section of the screw rotor 110 extending from the suction head end 111 to the exhaust tail end 112, and the remaining part of the working side 125 of the spool valve 120 is located at the outer side of the suction head end 111 of the screw rotor 110. When the spool valve 120 moves during a stroke, the spool valve tail end 122 is always located between the suction head end 111 and the exhaust tail end 112 of the screw rotor 110, and an exhaust capacity adjusting distance D1 is formed between the spool valve tail end 122 and the exhaust tail end 112. When the spool valve 120 is in the first position 210 shown in FIG. 2A, the exhaust capacity adjusting distance D1 is the largest, so that the screw compressor 100 has the largest discharge chamber volume Vd, and thus produces the actual minimum internal volume ratio $Vi_{min}$.

Figure 2B:
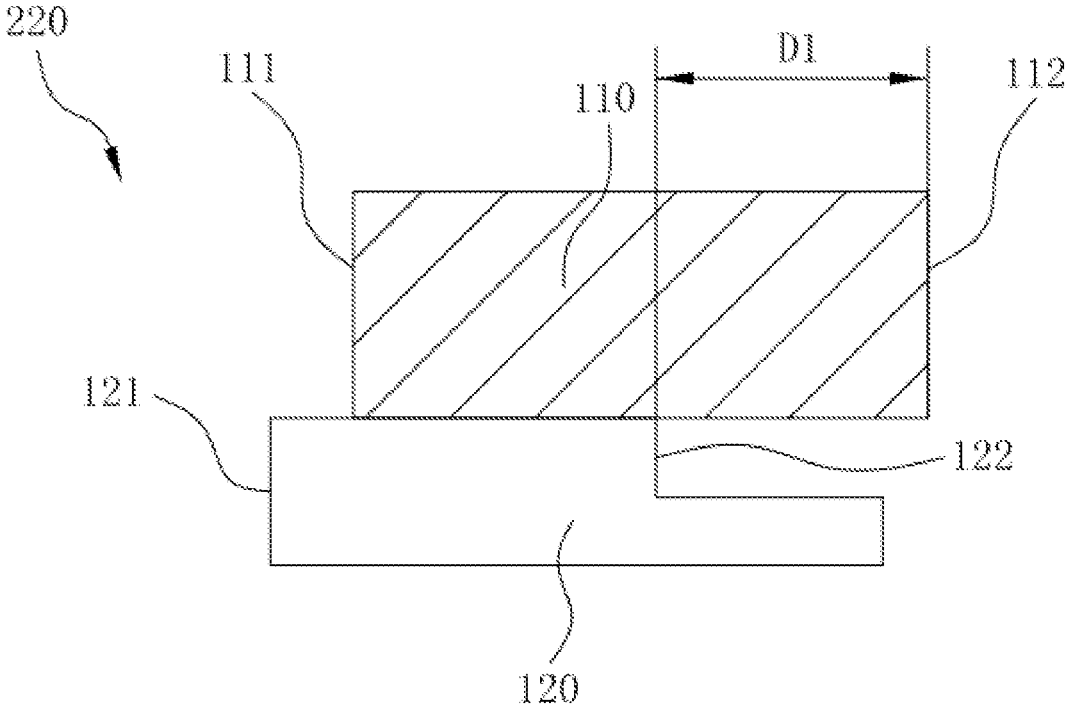
Figure 2C:
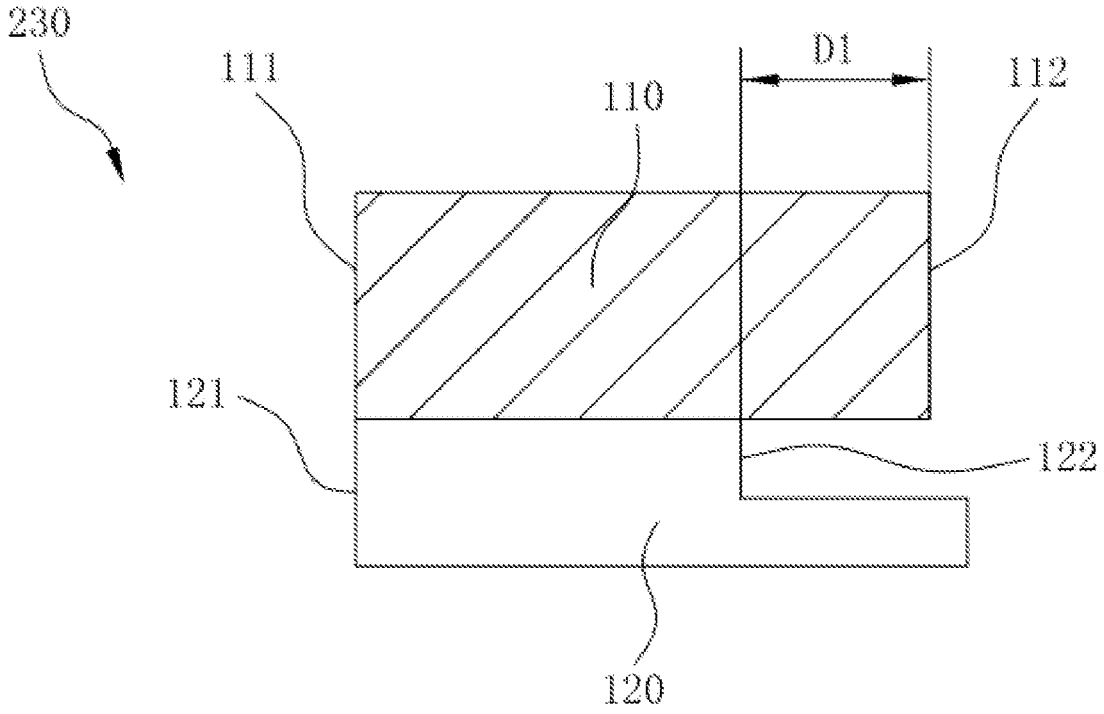

As shown in FIG. 2C, the spool valve head end 121 is aligned with the suction head end 111 of the screw compressor 100, and this position is a second position 230 of the spool valve 120. At the second position 230, all of the working side 125 of the spool valve 120 is located below the screw rotor 110, so that all of the working side 125 can shield the section of the screw rotor 110 extending from the suction head end 111 to the exhaust tail end 112. When the spool valve 120 is at the second position 230 shown in FIG. 2C, without changing the suction chamber volume Vs, the exhaust capacity adjusting distance D1 reaches the minimum value, thus producing the actual maximum internal volume ratio $Vi_{max1}$.

As shown in FIG. 2B, the spool valve 120 moves to a point between the first position 210 and the second position 230, which is an internal volume ratio adjusting position 220 of the spool valve 120. At the internal volume ratio adjusting position 220, the spool valve head end 121 is located at the outer side of the suction head end 111 of the screw rotor 110, and a part of the working side 125 of the spool valve 120 is located below the screw rotor 110, so as to shield the section of the screw rotor 110 extending from the suction head end 111 to the exhaust tail end 112, and the remaining part of the working side 125 of the spool valve 120 is located at the outer side of the suction head end 111 of the screw rotor 110. Compared with the first position 210 shown in FIG. 2A, at the internal volume ratio adjusting position 220 shown in FIG. 2B, the exhaust capacity adjusting distance D1 formed between the spool valve tail end 122 and the exhaust tail end 112 is smaller, so that the discharge chamber volume Vd becomes smaller, but the internal volume ratio Vi is higher because the suction chamber volume Vs remains unchanged.

Figure 2D:
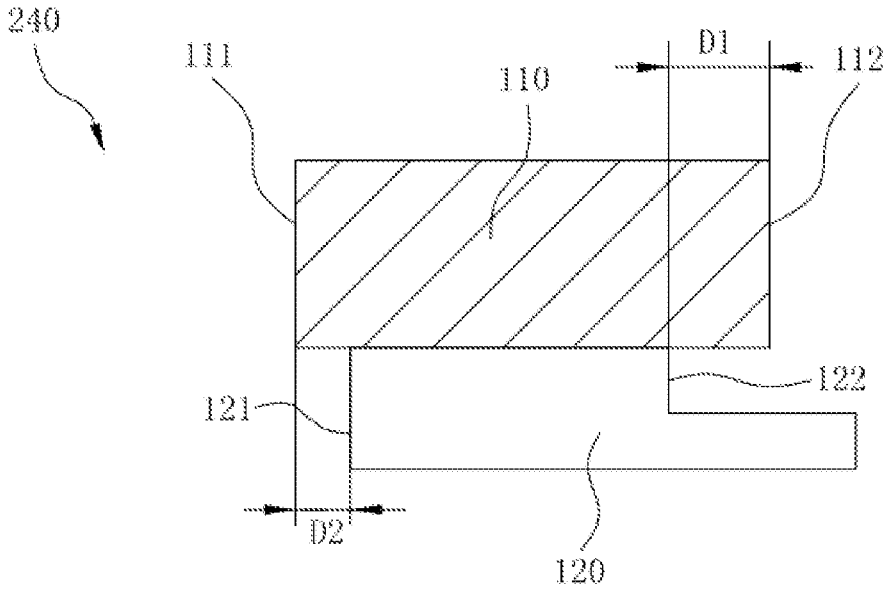
Figure 2E:
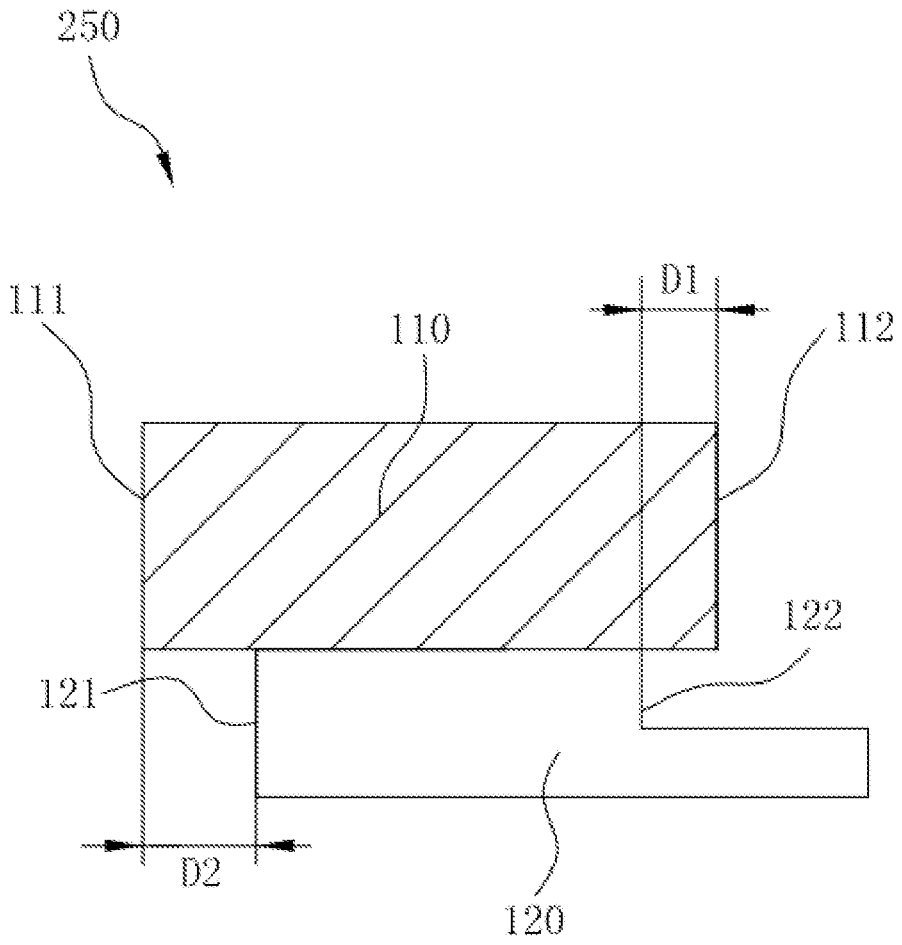

As shown in FIG. 2E, the spool valve 120 is located at the position of the maximum stroke moving toward the exhaust tail end 112 (to the right), and this position is a third position 250 of the spool valve 120. At the third position 250, the spool valve head end 121 is located at the inner side of the suction head end 111 of the screw compressor 100, and all the working side 125 of the spool valve 120 is below the screw rotor 110, so that all the working side 125 of the spool valve 120 can shield the section of the screw rotor 110 between the suction head end 111 and the exhaust tail end 112. At this point, in addition to the exhaust capacity adjusting distance D1 formed between the spool valve tail end 122 and the exhaust tail end 112, a suction capacity adjusting distance D2 is also formed between the spool valve head end 121 and the suction head end 111. At this point, the suction capacity adjusting distance D2 is the largest, and the screw compressor 100 has the smallest suction chamber volume Vs.

As shown in FIG. 2D, the spool valve 120 is located at a point between the second position 230 and the third position 250, which is a suction capacity adjusting position 240 of the spool valve 120. At the suction capacity adjusting position 240, the spool valve head end 121 is located at the inner side of the suction head end 111 of the screw compressor 100, and all the working side 125 of the spool valve 120 is below the screw rotor 110, so that all the working side 125 of the spool valve 120 can shield the section of the screw rotor 110 between the suction head end 111 and the exhaust tail end 112. At this point, in addition to the exhaust capacity adjusting distance D1 formed between the spool valve tail end 122 and the exhaust tail end 112, a suction capacity adjusting distance D2 is also formed between the spool valve head end 121 and the suction head end 111. Compared with the second position 230 shown in FIG. 2C, when the spool valve 120 is at the suction capacity adjusting position 240 shown in FIG. 2D, the suction chamber volume Vs becomes smaller due to the existence of the suction capacity adjusting distance D2, thereby reducing the suction capacity of the screw compressor 100. In addition, although the suction chamber volume Vs becomes smaller, since the exhaust capacity adjusting distance D1 becomes smaller and the exhaust chamber volume Vd also becomes smaller, the actual internal volume ratio Vi will only decrease slightly, and it can be deemed as an approximation that the actual internal volume ratio Vi remains unchanged. Compared with the third position 250 shown in FIG. 2E, when the spool valve 120 is located at the suction capacity adjusting position 240 shown in FIG. 2D, the suction capacity adjusting distance D2 is smaller.

By adjusting the position of the spool valve 120 in the area between the first position 210 and the second position 230 (i.e., the internal volume ratio adjusting position 220), the actual internal volume ratio Vi of the screw compressor 100 can be adjusted. The adjustment range of the actual internal volume ratio Vi is greater than or equal to $Vi_{min}$, (at the first position 210) and smaller than or equal to $Vi_{max1}$ (at the second position 230). Because the suction chamber volume Vs remains unchanged when the spool valve 120 moves in the area between the first position 210 and the second position 230, the actual internal volume ratio Vi and the position of the spool valve 120 are in a one-to-one linear correlation.

By adjusting the position of the spool valve 120 in the area between the second position 230 and the third position 250 (i.e., the suction capacity adjusting position 240), the suction chamber volume Vs of the screw compressor 100 can be adjusted, thereby adjusting the suction capacity of the screw compressor 100. As mentioned above, when the spool valve 120 moves in the area between the second position 230 and the third position 250, it can be approximately deemed that the actual internal volume ratio Vi remains unchanged.

Corresponding to different loads, the screw compressor 100 will have different integrated part load values when operating at different working frequencies and internal volume ratios Vi. In order to improve performance and efficiency, it is necessary to adjust the working frequency and internal volume ratio Vi of the screw compressor 100 according to different load conditions so that it runs at the best efficiency point as much as possible. Generally, the smaller the load, the smaller the suction capacity required, and the lower the corresponding working frequency. For example, under the following different loads, corresponding to different internal volume ratios Vi and working frequencies F, the integrated part load value of the screw compressor 100 can reach the maximum value: under 100% load, Vi=2.3, F=50 Hz; under 75% load, Vi=1.8, F=35 Hz; under 50% load, Vi=1.65, F=22.5 Hz; and under 25% load, Vi=1.65, F=12.5 Hz.

Since the cooling efficiency of the screw compressor 100 will decrease as the working frequency and the suction capacity lower, leading to higher exhaust temperature and unit temperature, although it is possible to adjust the suction capacity by adjusting the working frequency, the adjustment range is limited by excessively high temperatures, and it is not advisable to reduce the suction capacity through lowering the working frequency in order to meet the requirement for lower loads when the working frequency is reduced to a certain extent in consideration of the impacts of lowering the working frequency on the unit temperature.

In the present application, when the screw compressor 100 runs at the minimum working frequency (i.e., the working frequency threshold Ft), if the load continues to decrease, the working frequency is no longer reduced but is maintained at the working frequency threshold Ft, and the spool valve 120 is moved to a suitable suction capacity adjusting position 240. In this way, it is possible to continue to reduce the suction capacity without lowering the working frequency to adapt to changes in the load, thereby eliminating the limitation of working frequency adjustment and broadening the application range of the screw compressor 100.

FIG. 3 is a simplified schematic diagram of the spool valve 120 and the probe 131 shown in FIG. 1B, used to show the relative positions of the groove 126 on the spool valve 120 for accommodating the probe 131, and the probe 131. As shown in FIG. 3, the bottom surface 301 of the groove 126 of the spool valve 120 is an inclined surface that gradually inclines inward along the screw axis direction, so that the depth of the groove 126 gradually increases from the spool valve head end 121 to the spool valve tail end 122. The contact end 132 of the probe 131 extends into the groove 126 and contacts the bottom surface 301 of the groove 126, and the measurement end 133 of the probe 131 protrudes from the groove 126. As mentioned above, when the spool valve 120 moves in the direction of the screw axis, the probe 131 cannot move in the direction of the screw axis, but will move in the direction perpendicular to the screw axis. As the spool valve 120 moves in the axial direction, the length of the portion of the probe 131 protruding from the groove 126 changes accordingly, and forms a linear correlation with the position of the spool valve 120. In other embodiments, the bottom surface 301 of the groove 126 may also incline to the opposite direction, i.e., the depth of the groove 126 gradually increases from the spool valve tail end 122 to the spool valve head end 121.

In FIG. 3, area A represents the area where the probe 131 moves relative to the spool valve 120 when the spool valve 120 moves between the first position 210 and the second position 230. Since the internal volume ratio Vi of the screw compressor can be adjusted when the spool valve 120 moves between the first position 210 and the second position 230, area A can be regarded as area A for adjusting the internal volume ratio Vi. Area B represents the area where the probe 131 moves relative to the spool valve 120 when the spool valve 120 moves between the second position 230 and the third position 250. Since the suction capacity of the screw compressor can be adjusted when the spool valve 120 moves between the second position 230 and the third position 250, area B can be regarded as area B for adjusting the suction capacity. The method for controlling the screw compressor in the present application will be described below with reference to area A for adjusting the internal volume ratio Vi and area B for adjusting the suction capacity shown in FIG. 3.

Since the position of the spool valve 120 determines the suction volume Vs and the discharge volume Vd of the screw compressor, there is a linear correlation between the internal volume ratio Vi and the position of the spool valve 120. According to the control method of the present application, based on the linear correlation between the internal volume ratio Vi and the position of the spool valve 120, whether the spool valve 120 moves in area A for adjusting the internal volume ratio Vi or in area B for adjusting the suction capacity, the internal volume ratio Vi is used to determine the position of the spool valve 120, so that the position of the spool valve 120 can be adjusted based on the value of the internal volume ratio Vi during the control process. However, when the spool valve 120 moves in area B for adjusting the suction capacity, the actual internal volume ratio Vi of the screw compressor is approximately unchanged. Therefore, the present application uses a virtual internal volume ratio Vi to determine the position of the spool valve 120 when it moves in area B for adjusting the suction capacity. Both the virtual internal volume ratio Vi and the actual internal volume ratio Vi follow the linear correlation between the internal volume ratio Vi and the position of the spool valve 120.

Specifically, in area A for adjusting the internal volume ratio Vi, the position of the spool valve 120 is in a linear correlation with the actual internal volume ratio Vi. At the first position 210, the actual minimum internal volume ratio $Vi_{min}$ is reached; at the second position 230, the actual maximum internal volume ratio Vi is reached. Therefore, the position of the spool valve 120 can be adjusted based on the value of the internal volume ratio Vi within the range of [$Vi_{min}$, $Vi_{max1}$], so that the screw compressor 100 has the corresponding actual internal volume ratio Vi.

In area B for adjusting the suction capacity, the actual internal volume ratio Vi can be approximately regarded as unchanged, and the change in the position of the spool valve 120 is used to adjust the suction capacity. In order to maintain consistency of the control method, a corresponding virtual internal volume ratio Vi can be set for the position of the spool valve 120 according to the same linear correlation in the area for adjusting the internal volume ratio Vi, so that a unified control method and control system can be used to adjust the position of the spool valve 120. The rotor profile of the screw rotor 110 is used to calculate the suction capacities corresponding to the different positions of the spool valve 120, and the correlation between the virtual internal volume ratio Vi and the suction capacity can be established. At the third position 250, the virtual maximum internal volume ratio $Vi_{max2}$ is reached. Therefore, the position of the spool valve 120 can be adjusted within the range of [$Vi_{max1}$, $Vi_{max2}$] based on the value of the internal volume ratio Vi, so that the screw compressor 100 has a corresponding suction capacity.

The position sensor 130 can accurately determine the position of the spool valve 120, and can be used to indicate the actual internal volume ratio Vi of the screw compressor 100 in area A for adjusting the internal volume ratio Vi, so as to match it with the working condition in real time; in area B for adjusting the suction capacity, it can be used to indicate changes in the suction capacity.

Through the limiting structures 142 and 143 (refer to FIG. 1A), the spool valve 120 can be accurately moved to the first position 210 ($Vi_{min}$) and the third position 250 ($Vi_{max2}$), thereby facilitating the determination and calibration of the position sensor 130 and facilitating the structural design of the position sensor 130 and the groove 126.

Figure 4:
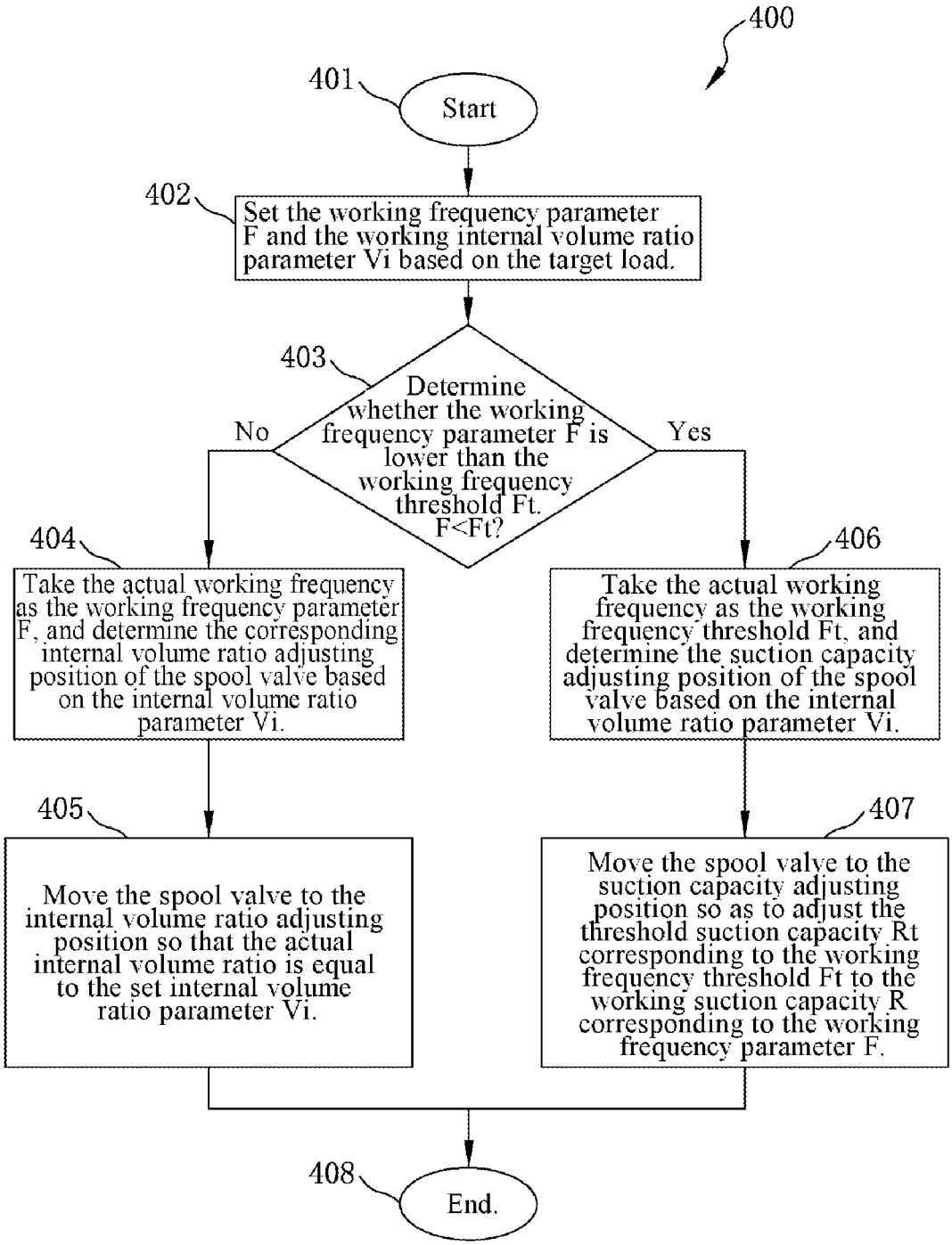
FIG. 4 is a flow chart of one embodiment of the control method for the screw compressor of the present application.

FIG. 4 is a flow chart of one embodiment of the control method for the screw compressor. As shown in FIG. 4, in step 401, when the load has changed, the internal volume ratio Vi and the working frequency F need to be adjusted to adapt to the load change.

In step 402, the corresponding working frequency parameter F and the working internal volume ratio Vi are set or determined based on the target load, and the process then goes to step 403. Among them, the working frequency parameter F corresponds to a predetermined working suction capacity R. The values of these parameters can be determined by pre-set formulas, algorithms or scales.

In step 403, the working frequency parameter F set in step 402 is compared with the working frequency threshold Ft. If the working frequency parameter F is no lower than the working frequency threshold Ft, the process then goes to step 404; if the working frequency parameter F is lower than the working frequency threshold Ft, the process then goes to step 406. The working frequency threshold Ft, corresponding to the minimum speed at which the screw compressor 100 can work normally, is related to the inherent performance of the screw compressor 100, and can be pre-set by the manufacturer. The working frequency threshold Ft corresponds to the threshold suction capacity Rt.

In step 404, the actual working frequency is taken as the working frequency parameter F, the corresponding internal volume ratio adjusting position 220 of the spool valve 120 is determined based on the internal volume ratio parameter Vi, and the process then goes to step 405. By changing the actual working frequency to the working frequency parameter F, the speed of the screw rotor 110 of the screw compressor 100 can be adjusted, thereby adjusting the suction capacity of the screw compressor 100 to the predetermined working suction capacity R. Moreover, after the corresponding internal volume ratio adjusting position 220 of the spool valve 120 is determined based on the internal volume ratio parameter Vi, the displacement L1 for the spool valve 120 to move to the corresponding internal volume ratio adjusting position 220 can be determined based on the current position of the spool valve 120. The current position of the spool valve 120 can be determined by the position sensor 130.

In step 405, the spool valve 120 is moved to the corresponding internal volume ratio adjusting position 220. At this point, the spool valve head end 121 is located at the outer side of the suction head end 111 of the screw rotor 110 or aligned with the suction head end 111, so that the spool valve 120 can shield the section of the screw rotor 110 extending from the suction head end 111 to the exhaust tail end 112 so that the actual internal volume ratio is equal to the set internal volume ratio parameter Vi.

In step 406, the actual working frequency is taken as the working frequency threshold Ft, the suction capacity adjusting position 240 of the spool valve 120 corresponding to the predetermined working suction capacity R is determined based on the internal volume ratio parameter Vi, and the process then goes to step 407. The speed of the screw rotor 110 can be adjusted by changing the working frequency. Moreover, after the suction capacity adjusting position 240 of the spool valve 120 corresponding to the predetermined working suction capacity R is determined based on the internal volume ratio parameter Vi, the displacement L2 for the spool valve 120 to move to the corresponding suction capacity adjusting position 240 can be determined based on the current position of the spool valve 120. The current position of the spool valve 120 can be determined by the position sensor 130.

In step 407, the spool valve 120 is moved to the corresponding suction capacity adjusting position 240. At this point, the spool valve head end 121 is located at the inner side of the suction head end 111 of the screw rotor 110, and a suction capacity adjusting distance D2 is formed between the spool valve head end 121 and the suction head end 111, thereby adjusting the threshold suction capacity Rt corresponding to the working frequency threshold Ft to the working suction capacity R corresponding to the working frequency parameter F.

In step 408, this adjustment ends, and the above steps are repeated to adjust the screw compressor 100 accordingly when the load changes again.

Figure 5A:
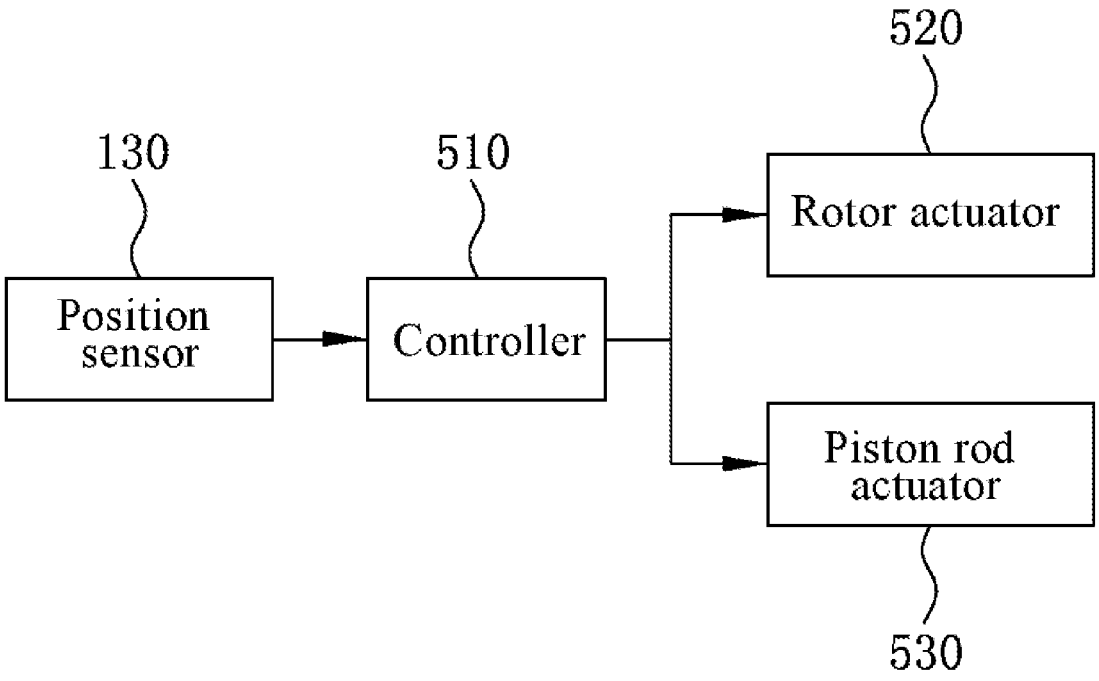
FIG. 5A is a block diagram of one embodiment of the control system of the screw compressor of the present application.
Figure 5B:
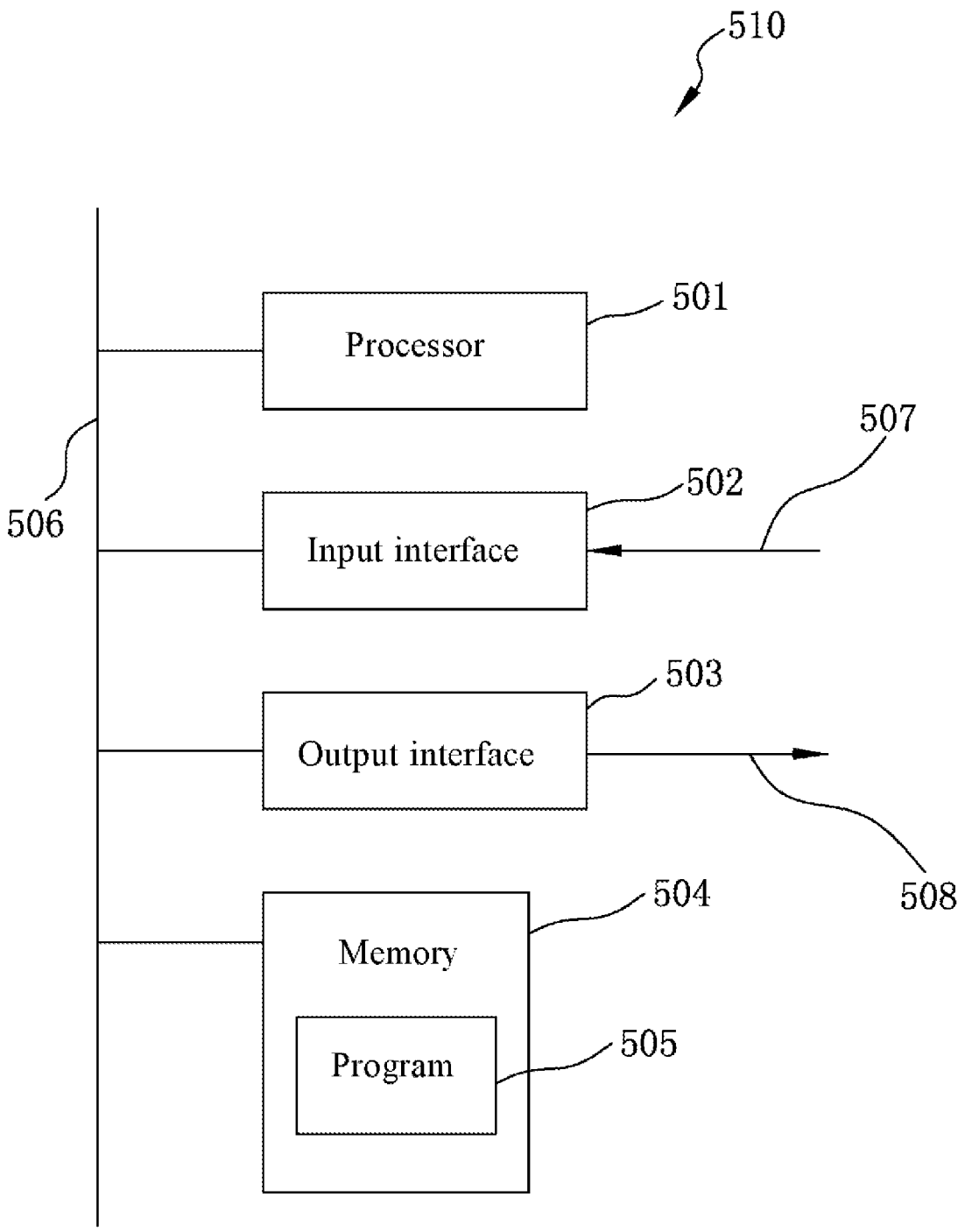
FIG. 5B is a block diagram of the controller in FIG. 5A.

FIG. 5A shows a block diagram of one embodiment of the control system of the screw compressor of the present application. As shown in FIG. 5A, the screw compressor 100 further comprises a controller 510, a rotor actuator 520 for the screw rotor 110, and a piston rod actuator 530 for the piston rod. The controller 510 is in a communication connection with the rotor actuator 520 of the screw rotor 110 to adjust the speed of the screw rotor 110 by adjusting the working frequency, thereby adjusting the suction capacity of the screw compressor 100. The controller 510 is also in a communication connection with the position sensor 130 to determine the position of the spool valve 120 based on the signal generated by the position sensor 130. The controller 510 is also in a communication connection with the piston rod actuator 530 to drive, through the piston rod actuator 530, the piston rod 140 to drive the spool valve 120 to move, thereby adjusting the position of the spool valve 120. In some embodiments, the piston rod actuator 530 is a hydraulic transmission device. FIG. 5B is a block diagram of the controller 510 shown in FIG. 5A. As shown in FIG. 5B, the controller 510 comprises a processor 501, an input interface 502, an output interface 503, a memory 504 with a program 505, and a bus 506. The processor 501, the input interface 502, the output interface 503, and the memory 504 are communicatively connected through the bus 506, so that the processor 501 can control the operation of the input interface 502, the output interface 503, and the memory 504. The memory 504 is used to store programs, instructions, and data. The processor 501 reads programs, instructions, and data from the memory 504, and can write data to the memory 504.

The input interface 502 receives signals and data through the connection 507, such as a signal indicating the position of the spool valve 120 from the position sensor 130, various manually input parameters, etc. The output interface 503 sends signals and data through the connection 508, such as corresponding control signals, etc. to the rotor actuator 520 and the piston rod actuator 530. The memory 504 stores control programs and data including various pre-set values, parameters, etc., such as the control program of the screw compressor 100, the working frequency threshold Ft, the instruction for the action to be taken when the threshold is reached or certain conditions are met, etc. Various parameters can be set in advance in the production engineering, and various parameters can be set by manual input or data import during use. The processor 501 obtains various signals, data, programs and instructions from the input interface 502 and the memory 504, performs corresponding processing, and outputs them through the output interface 503.

Through long-term observations and experiments, the inventors of the present application have found that, due to the limitation of the working characteristics of screw compressors with a fixed internal pressure ratio, the integrated part load value deviation of existing variable-frequency screw sets is significantly lower than that of the variable-frequency centrifugal sets; existing variable-frequency screw sets are subject to the protection limits on the compressor motor heating and high exhaust temperature at a low frequency, the working frequency cannot be too low, and the operational range is limited to a certain extent; and two independent mechanisms are used to adjust the internal volume ratio Vi and the suction capacity of existing screw compressor sets, which are complicated in structure and high in cost.

Through the structural design and control of the spool valve 120, the screw compressor 100 of the present application can realise continuous adjustment of the internal volume ratio Vi, and further has the function of adjusting the suction capacity and at the same time the function of indicating the internal volume ratio Vi and the suction capacity, thus improving the operation efficiency, widening the adjustment range of the applicable internal volume ratio Vi, simplifying the structure, and making it easy to standardise. At the same time, the operational range and load regulation ability of the screw compressor 100 are expanded. The coordinated control of the suction capacity adjustment through the spool valve 120 and the screw rotor 110 effectively solves the problem of excessively high operating temperatures. The screw compressor 100 of the present application can be used in an air-conditioning system in conjunction with a variable-frequency drive, a heat exchanger and a throttling device. Through the effective combination of variable-frequency adjustment of the speed and the suction capacity and the adjustment of the internal volume ratio Vi, real-time operating efficiency can be maximised.

Examples are used in the description to disclose the present application, one or more of which are illustrated in the drawings. Each example is provided to explain the present application, not to limit it. In fact, it is obvious to those skilled in the art that various modifications and variations can be made to the present application without departing from the scope or spirit of the present application. For example, features illustrated or described as part of one embodiment may be used in combination with another embodiment to obtain a further embodiment. Therefore, it is intended that the present application covers modifications and variations made within the scope of the claims and their equivalents.

The invention claimed is:

1. A screw compressor comprising:

a screw rotor comprising a suction head end and an exhaust tail end, wherein the screw rotor is configured to suck in gas from the suction head end and discharge compressed gas from the exhaust tail end; and a spool valve comprising a working side for sealing a compression chamber of the screw rotor, wherein the working side comprises a spool valve head end and a spool valve tail end, the spool valve head end and the spool valve tail end are arranged in a common direction as the suction head end and the exhaust tail end of the screw rotor along an axis direction of the screw rotor, and the spool valve is configured for reciprocating motion along the axis direction of the screw rotor;

wherein the spool valve is configured to move to a suction capacity adjusting position, wherein, in the suction capacity adjusting position, the spool valve head end is located at an inner side of the suction head end of the screw rotor, and a suction capacity adjusting distance is formed between the spool valve head end and the suction head end, wherein the suction capacity adjusting distance is adjustable to adjust a suction capacity of the screw compressor without changing a speed of the screw rotor.

2. The screw compressor of claim 1, wherein:

the spool valve is configured to move to an internal volume ratio adjusting position, wherein, in the internal volume ratio adjusting position, the spool valve head end is located at an outer side of the suction head end of the screw rotor or is aligned with the suction head end, such that the spool valve is configured to adjust an internal volume ratio of the screw compressor.

3. The screw compressor of claim 1, comprising:

a position sensor located between the suction head end and the exhaust tail end of the screw rotor in the axis direction, wherein the position sensor is in contact with the spool valve, and the position sensor is configured to indicate a position of the spool valve.

4. The screw compressor of claim 3, wherein:

a non-working side of the spool valve has an inclined surface that is inclined relative to the screw rotor in the axis direction, the position sensor comprises a probe having a fixed position along the axis direction, wherein one end of the probe is in contact with the inclined surface and is configured to slide relative to the inclined surface as the spool valve moves, and wherein the probe is configured to move in a direction perpendicular to the axis direction as the spool valve moves, and the position sensor is configured to determine the position of the spool valve based on a distance that the probe moves in the direction perpendicular to the axis direction.

5. The screw compressor of claim 4, wherein:

the non-working side of the spool valve has a groove extending along the axis direction, and a bottom surface of the groove is inclined relative to the screw rotor in the axis direction, the probe has a contact end and a measurement end, wherein the contact end extends into the groove and contacts the bottom surface of the groove, wherein the contact end is configured to slide relative to the bottom surface as the spool valve moves, and the measurement end protrudes from the groove, and the position sensor is configured to determine the position of the spool valve based on a length of a portion of the probe protruding from the groove.

6. The screw compressor of claim 1, wherein:

when the spool valve is in a first position, the spool valve head end is located at an outer side of the suction head end of the screw rotor, a portion of a working side of the spool valve is configured to shield a section of the screw rotor extending from the suction head end to the exhaust tail end, and the screw compressor has an actual minimum internal volume ratio ($Vi_{min}$), wherein the first position is a first maximum stroke position of the spool valve toward the suction head end, when the spool valve is in a second position, the spool valve head end is aligned with the suction head end of the screw compressor, an entirety of the working side of the spool valve is configured to shield the section of the screw rotor extending from the suction head end to the exhaust tail end, and the screw compressor has an actual maximum internal volume ratio ($Vi_{max1}$), and when the spool valve is in a third position, the spool valve head end is located at the inner side of the suction head end of the screw compressor, the entirety of the working side of the spool valve is configured to shield the section of the screw rotor between the suction head end and the exhaust tail end, and the screw compressor has a virtual maximum internal volume ratio ($Vi_{max2}$), wherein the third position is a second maximum stroke position of the spool valve toward the exhaust tail end.

7. The screw compressor of claim 6, wherein:

the screw compressor is configured to adjust a position of the spool valve between the first position and the second position to adjust an internal volume ratio (Vi) of the screw compressor; and the screw compressor is configured to adjust the position of the spool valve between the second position and the third position to adjust a suction chamber volume of the screw compressor, and thereby adjust the suction capacity of the screw compressor.

8. The screw compressor of claim 1, comprising:

a piston rod connected to the spool valve tail end, wherein the piston rod is configured to be hydraulically driven to drive the spool valve to move reciprocally along the axis direction.

9. The screw compressor of claim 8, comprising:

a controller configured to adjust the speed of the screw rotor and configured to control a piston rod actuator to drive the piston rod to adjust a position of the spool valve.

10. A control method for operating a screw compressor, comprising:

a) setting a working frequency parameter (F) and a working internal volume ratio parameter (Vi) of the screw compressor based on a target load, wherein the working frequency parameter (F) corresponds to a predetermined working suction capacity (R);

b) determining whether the working frequency parameter (F) is lower than a working frequency threshold (Ft), wherein the working frequency threshold (Ft) corresponds to a threshold suction capacity (Rt); and c) adjusting a position of a spool valve based on the working frequency parameter al and the working internal volume ratio parameter wherein:

c1) when the working frequency parameter (F) is not lower than the working frequency threshold (Ft), (i) the working frequency parameter (F) is set as a working frequency of the screw compressor to adjust a speed of a screw rotor of the screw compressor and to adjust a suction capacity of the screw compressor toward the predetermined working suction capacity (R), and a displacement (L1) of the spool valve moving to an internal volume ratio adjusting position corresponding to the working internal volume ratio parameter is determined based on the set working internal volume ratio parameter (Vi), and (ii) the spool valve is moved to the internal volume ratio adjusting position based on the displacement (L1), and, when the spool valve is in the internal volume ratio adjusting position, a spool valve head end of the spool valve is located at an outer side of a suction head end of the screw rotor of the screw compressor or is aligned with the suction head end, such that the spool valve shields a section of the screw rotor extending from the suction head end to an exhaust tail end of the screw rotor, and c2) when the working frequency parameter (F) is lower than the working frequency threshold (Ft), (i) the working frequency threshold (Ft) is set as the working frequency of the screw compressor to adjust the speed of the screw rotor, and a displacement (L2) of the spool valve moving to a suction capacity adjusting position corresponding to the predetermined working suction capacity (R) is determined based on the working internal volume ratio parameter (Vi), and (ii) the spool valve is moved to the suction capacity adjusting position based on the displacement (L2), and, when the spool valve is in the suction capacity adjusting position, the spool valve head end is located at an inner side of the suction head end of the screw rotor, and a suction capacity adjusting distance (D2) is formed between the spool valve head end and the suction head end, such that the threshold suction capacity (Rt) corresponding to the working frequency threshold (Ft) is adjusted to the predetermined working suction capacity (R).

11. The control method for operating the screw compressor of claim 10, wherein:

an actual internal volume ratio reached in step c1 is equal to the working internal volume ratio parameter (Vi), and the working internal volume ratio parameter (Vi) of the screw compressor is between an actual minimum internal volume ratio ($Vi_{min}$) and an actual maximum internal volume ratio ($Vi_{max1}$), and the actual internal volume ratio reached in step c2 is determined based on the predetermined working suction capacity (R), and the working internal volume ratio parameter (Vi) of the screw compressor is between the actual maximum internal volume ratio ($Vi_{max1}$) and a virtual maximum internal volume ratio ($Vi_{max2}$).

12. The control method for operating the screw compressor of claim 10, wherein:

the working frequency threshold (Ft), corresponds to a minimum speed for normal operation of the screw compressor.

* * * * *